US005448283A

United States Patent [19]

Takeuchi

[11] Patent Number: 5,448,283

[45] Date of Patent: Sep. 5, 1995

[54] THERMAL TRANSFER PRINTER INCLUDING CONTROL OF RELATIVE RATES OF SPEED OF FEEDING OF INK SHEET AND RECORDING PAPER BASED ON CORRECTED COUNT OF GRADATION PULSES

[75] Inventor: Hiroaki Takeuchi, Yokohamashi, Japan

[73] Assignee: Ricoh Company, Ltd., Tokyo, Japan

[21] Appl. No.: 177,392

[22] Filed: Jan. 5, 1994

[30] Foreign Application Priority Data

Jan. 27, 1993 [JP] Japan ..... 5-031307
May 17, 1993 [JP] Japan ..... 5-139120

[51] Int. Cl.[6] ..... B41J 17/08; B41J 17/10; B41J 33/36; B41J 17/06

[52] U.S. Cl. ..... 347/217; 400/232

[58] Field of Search ..... 346/76 PH; 400/120, 400/232; 347/217

[56] References Cited

FOREIGN PATENT DOCUMENTS 0041578 2/1986 Japan ..... 400/232
0022082 1/1990 Japan ..... 400/232

*Primary Examiner*—Huan H. Tran
*Attorney, Agent, or Firm*—Popham, Haik, Schnobrich & Kaufman, Ltd.

[57] ABSTRACT

A thermal transfer printer which controls a speed of an ink sheet based on density information of document image data uses a counting part for counting the number of maximum density pixels or gradation pulses in document image data and uses a speed ratio changing part for changing a speed ratio between a feeding speed of a recording medium and a feeding speed of an ink sheet based on the number of maximum density pixels or gradation pulses which have been counted by the counting part.

14 Claims, 4 Drawing Sheets

THERMAL TRANSFER PRINTER INCLUDING CONTROL OF RELATIVE RATES OF SPEED OF FEEDING OF INK SHEET AND RECORDING PAPER BASED ON CORRECTED COUNT OF GRADATION PULSES

BACKGROUND OF THE INVENTION

1. Field of the Invention

This invention relates to a thermal transfer type printer or an impact type printer which feeds an ink sheet at 1/n times the feeding speed of a recording medium, (which is a so-called n times thermal transfer type printer) and especially to a thermal transfer type printer which controls the speed ratio between the feeding speed of a recording medium and a feeding speed of an ink sheet. (The n means a value which can be obtained by dividing the feeding speed of a recording paper by the feeding speed of an ink sheet, that is, n is a speed ratio between the feeding speed of a recording paper and the feeding speed of a ink sheet).

2. Description of the Prior Art

Generally, in a thermal transfer type printer, an ink sheet is placed on a recording paper and fed at a predetermined speed. A thermal transfer printer records an image on the recording paper by transferring ink to the recording paper using a thermal head to generate heat patterns in response to image data.

Recent developments in this area include an ink sheet which can be used with a number of sheets of recording paper. It is possible to record an image on the recording paper by feeding the ink sheet at 1/n times the speed of the recording paper, thereby decreasing the cost of using the ink sheet. The number n the "speed ratio", which is a ratio of the feeding speed of the recording paper and the feeding speed of the ink sheet.

The above described n times thermal transfer type printer can be constructed from a conventional thermal transfer type printer without having to make major modifications to the conventional thermal transfer type printer. The ink sheet might be too short.

FIG. 9 shows the relation between the printing density and the speed ratio n, which is determined by dividing the feeding speed of the recording medium by the feeding speed of the ink sheet.

As the value of the speed ratio n approaches 1 (or as the feeding speed of the recording medium approaches the feeding speed of the ink sheet, as shown in FIG. 9), the printing density becomes darker. Conversely, as the value of the speed ratio n increases (or as the feeding speed of the recording medium becomes greater than the feeding speed of the ink sheet, as shown FIG. 9), the printing density becomes lighter.

However, a problem with the n times thermal transfer type printer is that the thermal transfer type printer often does not use ink efficiently. That is, often there is ink remaining on the ink sheet after it is fed through the printer. This occurs because the feeding speed of the ink sheet used for recording an image having a light density or having no image data at all is the same speed that is used for recording an image of dark or maximum density.

In Japanese Laid Open Patent No. 2-22082, a thermal printer for solving the problem described above is disclosed.

The thermal transfer type printer efficiently consumes ink on an ink sheet by changing the feeding speed of the ink sheet according to the density level of image data in each line of the image.

The thermal transfer printer determines the speed ratio n (the ratio of the feeding speed of the recording paper to the feeding speed of the ink sheet) by comparing the maximum density of the line of the image with the maximum density of the image or by comparing average image density in each line with image data of maximum density. Accordingly, the ratios are determined based on the maximum data or the average data in each line of the image. The speed ratios can be adjusted by changing the feeding speed of the ink sheet line by line. The feeding speed of the recording paper is constant.

However, determining the speed ratio line by line takes much time. Moreover, it can be difficult to change the feeding speed of the ink sheet line by line because the feeding speed of the ink sheet is controlled by a motor which may delay in responding to the change.

Further, since Japanese Laid Open Patent No. 2-22082 discloses only a thermal printer which uses a mono color ink sheet and does not discuss using a length of color ink area. The mono color thermal printer technology can not be applied to a thermal transfer printer which uses an ink sheet having repeatedly arranged color ink areas because lengths of these ink areas are predetermined. A recording area can exceed one color ink area so that a desired color image is not obtained.

SUMMARY OF THE INVENTION

It is an object of the present invention to overcome the above and other problems encountered in the aforementioned art.

It is another object of the present invention to provide a thermal transfer printer which feeds an ink sheet at 1/n times speed the feeding speed of recording medium.

It is a further object of the present invention to provide a thermal transfer printer which controls speed ratios between a feeding speed of a recording medium and feeding speeds of an ink sheet based on density of the image.

It is a further object of the present invention to provide a thermal transfer printer which forms accurate color images on a recording medium with no shear in printing.

The above and other objects of the present invention are achieved by a thermal transfer printer which controls the speed of an ink sheet based on density information derived from document image data. The thermal transfer printer includes a counting part for counting a number of maximum density pixels in the document image data and a speed ratio changing part for changing speed ratios between a feeding speed of a recording medium and feeding speeds of an ink sheet based on the number of maximum density pixels which have been counted by the counting part.

According to a further feature of the present invention, a thermal transfer printer controls feeding speed of an ink sheet based on density of a document image. The thermal transfer printer includes a counting part for counting a number of gradation pulses and a speed ratio changing part for changing speed ratios between a feeding speed of a recording medium and feeding speeds of an ink sheet based on the number of gradation pulses which have been counted by the counting part.

A thermal transfer printer according to the present invention counts a number of maximum density pixels and changes speed ratios between the feeding speed of a recording medium and feeding speeds of an ink sheet based on the number of maximum density pixels to thereby feed the ink sheet at a proper speed to obtain stable density.

The thermal transfer printer divides document image data into a plurality of blocks and counts the number of maximum density pixels in each block and changes the speed ratio of each block based on the number of the maximum density pixels.

According to a further feature of the present invention, the thermal transfer printer counts a number of a gradation pulse, (i.e. density information of document image data) and changes speed ratios between feeding speed of a recording medium and feeding speeds of an ink sheet based on the number of the gradation pulses to thereby feed the ink sheet at a proper feeding speed in order to obtain stable density of the image.

The thermal transfer printer according to the present invention divides document image data into a plurality of blocks and counts the number of the gradation pulse and changes the speed ratios based on the number of the graduation pulse for each block.

A thermal transfer printer according to the present invention changes speed ratios between neighboring blocks so that density differences do not appear if the difference between the values of neighboring blocks is greater than a predetermined value.

Furthermore, a thermal transfer printer according to the present invention changes speed ratios so that the length of an ink sheet for printing one color does not exceed the length of the color ink area on the ink sheet when using an ink sheet have a plurality of color ink areas arranged in order.

A thermal transfer printer according to the present invention determines that a feeding speed is zero and stops feeding an ink sheet when there is no image data in a divided block Other objects and features of the present invention will become apparent from the following detailed description when read in conjunction with the accompanying drawings.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

A description will now be given of preferred embodiments of a thermal transfer printer according to the present invention. The first embodiment is related to a thermal printer having a plurality of thermal heads corresponding to a number of color ink sheets.

Figure 1:
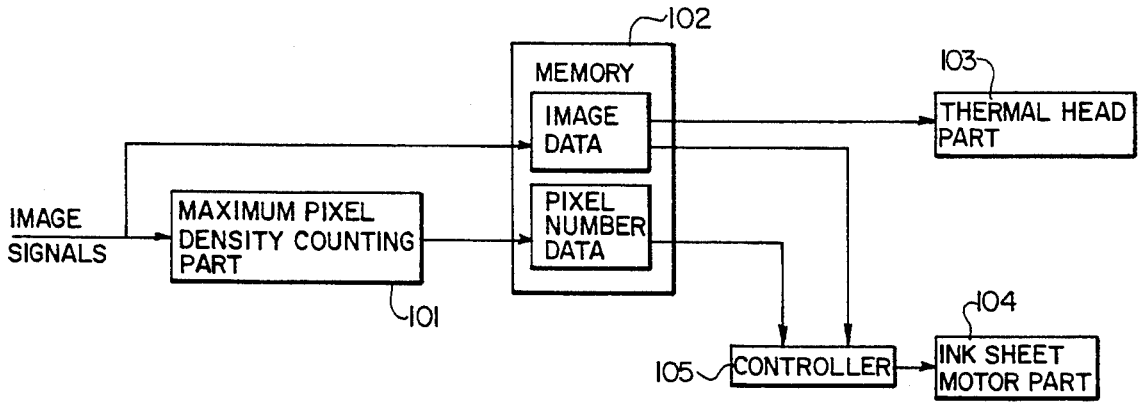
FIG. 1 is a schematic block diagram of a thermal transfer printer of the first embodiment.

FIG. 1 is a block diagram of the thermal printer according to the first embodiment. The printer includes a maximum density pixel counting part 101 which counts a number of maximum density pixels in document image data for each block (which consists of 15 lines of image data), a memory 102 in which image data and a number of maximum density pixels are recorded, a thermal head part 103 which prints an image on recording paper ( a recording medium ) using ink sheets, an ink sheet motor part 104 which feeds the ink sheets and a controller 105 which controls all the parts and calculates a plurality of speed ratios which are determined by dividing a recording medium feeding speed by an ink sheet feeding speed using the counted values. The speed of the motor 104 varies inversely according to the time between electrical pulses provided thereto by the controller 105.

The controller 105 determines the speed ratios by using a pixel number data table (a look-up-table) in which the speed ratios corresponding to the numbers of maximum density pixels are recorded.

As discussed above, the maximum density pixel counting part 101 counts how many maximum density pixels there are in a block consisting of 15 lines of image data. For example, in the case of A4 size paper (296 mm×210 mm, but the area which is actually to be recorded is 286 mm×205 mm), the number of printing lines on the recording paper is 3378 and a number of blocks on a recording paper is 225 (i.e. 3378/15). Consequently, the counting part 101 counts the number of maximum density pixels for each set of 15 lines of image data. That is, in this case, the counting part 101 counts the number of maximum density pixels 225 times. The following embodiments according to the present invention are explained for the case of 15 lines per block and 225 blocks per sheet of recording paper. However, the invention can be practiced with other values and therefore these numbers are not limited to 225, 15 and 3378.

Figure 2:
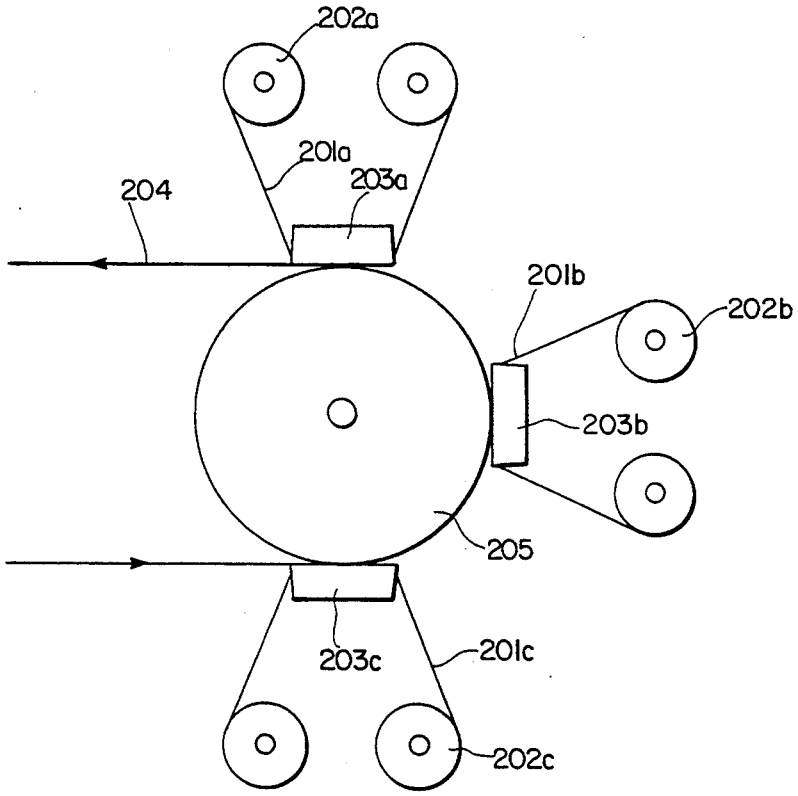
FIG. 2 is a schematic section view showing a thermal transfer printer to which the present invention is applied.

FIG. 2 is a schematic section view showing a thermal transfer printer of the first embodiment. A yellow ink sheet 201*a* is loaded in a cassette 202*a*, a magenta ink sheet 201*b* is loaded in a cassette 202*b*, and a cyan ink sheet 201*c* is loaded in a cassette 202*c*. A thermal head 203*a* for the yellow ink sheet 201*a*, a thermal head 203*b* for the magenta ink sheet 201*b*, and a thermal head 203*c* for the cyan ink sheet 201*c* are provided around a platen drum 205 which feeds recording paper 204 to the thermal head 203*a*, 203*b*, 203*c*.

Following is a description of a process for determining the speed ratios according to the first embodiment.

The maximum density pixel counting part 101 receives document image signals and counts a number of maximum density pixels in each block corresponding to divided image areas on a document. The accumulated value (the number of maximum density pixels) that the maximum density pixel counting part 101 has counted is recorded in a portion of the memory 102 each time the counting is completed. The controller 105 determines the speed ratios each corresponding to the number of the maximum density pixels which are recorded in the memory 102. The controller 105 determines speeds for the yellow ink sheet 201*a*, the magenta ink sheet 201*b* and the cyan ink sheet 201*c* by varying, according to the speed ratio, the time between the electrical pulses that drive the motor.

Figure 3:
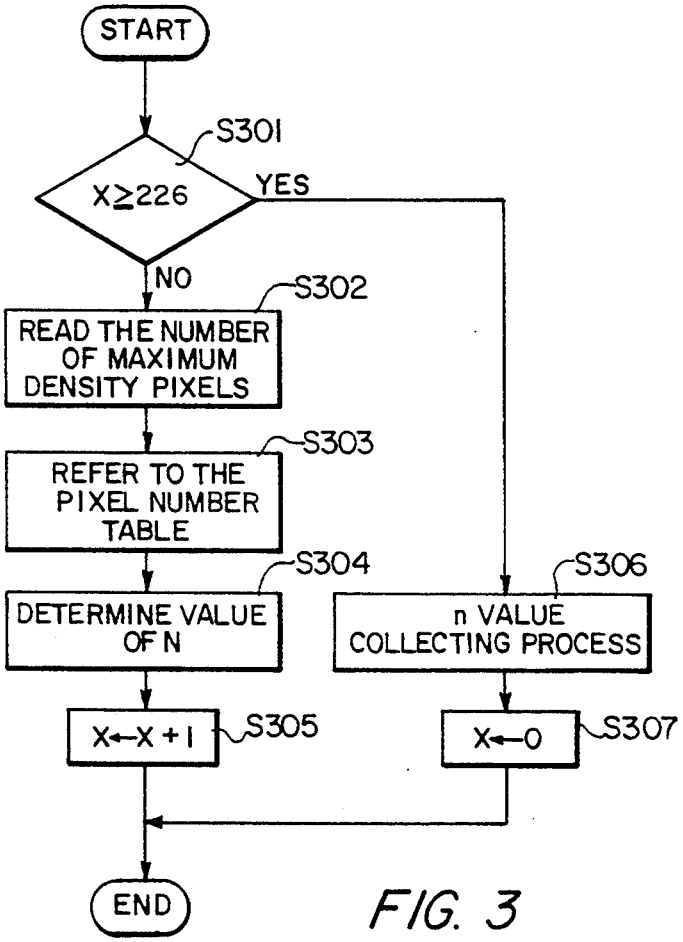
FIG. 3 is a flowchart explaining calculation of the n speed ratios.

Next, referring to FIG. 3, a calculating process will be explained.

At first, in a step 301, it is determined whether values of all blocks (225 blocks) have already been calculated. The process is advanced to a step 306 when x is larger than 225, i.e. when all the values for the blocks have been determined. On the other hand, the process is advanced to steps 302–305 when x is not larger than 225.

In the step 302, the number of maximum density pixels which have been counted by the maximum density pixel counting part 101 is read and then a value for n is determined in the steps 303, 304 by referring to the pixel number data table in a program located in the controller 105. At that time, if the number of pixels is 0, that is, there is no image data or the image density level is 0 for all data within the block, n is set to an appropriate value for stopping the ink sheet motor 104 in order to not feed the ink sheet. Next, x, the number of blocks of a present document image, is incremented in the step 305 and then the processing for the block ends.

In the step 306, a correcting process is carried out to determine values for each of the speed ratios (n) which have been determined ($x>225$ in the step 301). Each speed ratio (n) of each block is recorded in the memory 102 after it is determined. Accordingly, all of the speed ratios are recorded in the memory 102 when x reaches 225. The number representing the document image block x is set to 0 at a step 307 and the process ends.

The correcting process will be explained by referring to FIG. 4.

Figure 4:
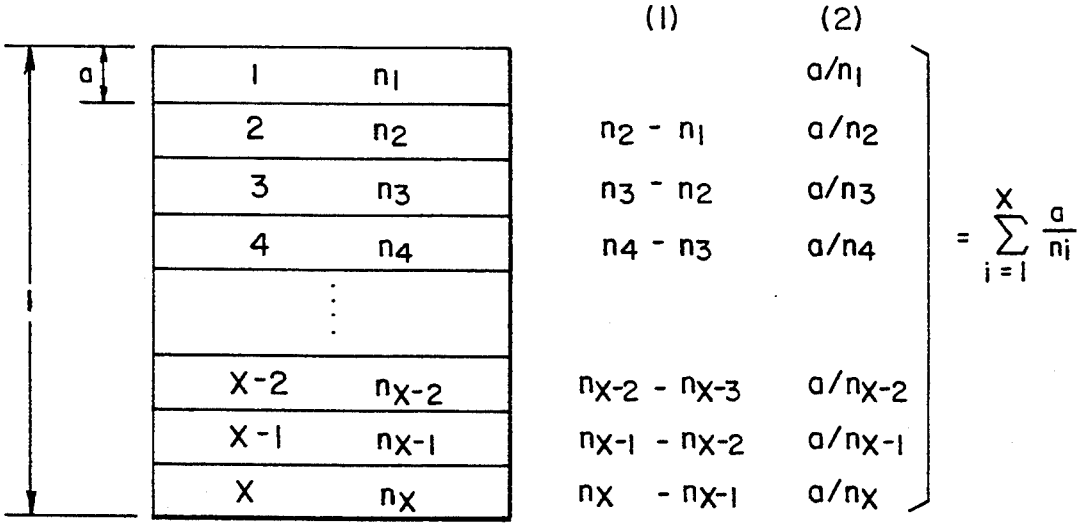
FIG. 4 is a diagram showing a correcting process.

FIG. 4 is a diagram showing the correcting process for each of the speed ratios (n). A document image is divided into X blocks. (In the illustrated embodiment, X is 225). In FIG. 4, a letter "a" shows a length of a block in the feeding direction of the ink sheet, a letter "I" shows a length of a printing area in the feeding direction. As shown in (1), initially, speed ratio differences between neighbor blocks are determined. A printing image can be unevenly recorded on a recording paper when revolutions of an ink sheet motor vary greatly between the neighbor blocks, for example, if the speed ratio differences are more than 5.0. Accordingly, the revolutionary speed of the drum is limited to a small change so that large density differences between neighbor blocks in the document image are minimized.

As mentioned above, according to the first embodiment, as speed ratios are determined based on maximum density data of document image data, appropriate speed ratios can be set and an ink sheet can be used efficiently.

It is possible to efficiently use an ink sheet in response to fine changes of density on a document image by dividing a document image into a plurality of blocks and counting maximum density pixels and finding a speed ratio (n) for each block.

Further, the present invention makes it possible to efficiently use an ink sheet, because the ink sheet is not provided for a block where there is no image data.

Figure 5:
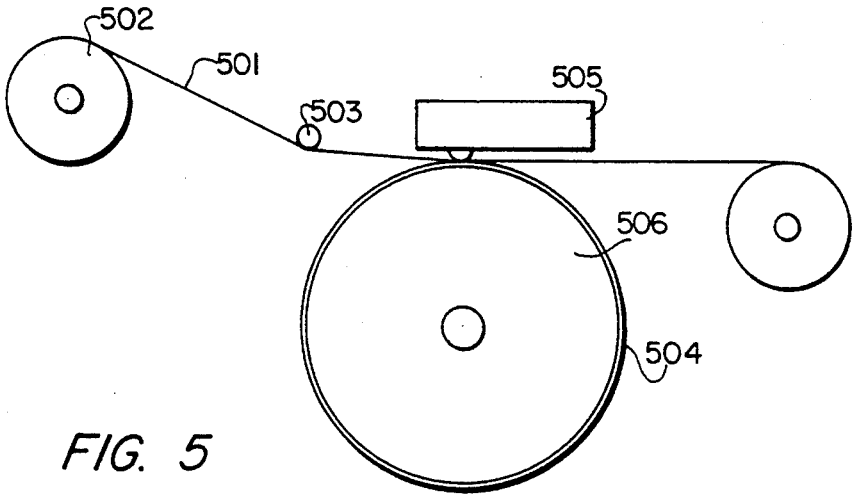
FIG. 5 is a schematic section view showing a printing unit of the second embodiment.

As shown in FIG. 5, the second embodiment shows a thermal transfer printer which records an image on a recording paper with a thermal head. As the structure of the second embodiment is basically the same as that of the first embodiment, the explanation of equivalent parts of the basic structure of the second embodiment is omitted.

FIG. 5 shows a schematic section view of a printing unit according to the second embodiment. Yellow, magenta and cyan ink areas are repeatedly arranged in order on a sheet 501 which is loaded in an ink sheet cassette 502. A supporting roller 503 supports the ink sheet 501. A thermal head 505 records an image on a recording paper 504 (a recording medium) by using heat. A platen drum 506 that supports the recording paper 504 is pressed by the thermal head 505 and radiates heat.

Figure 6A:
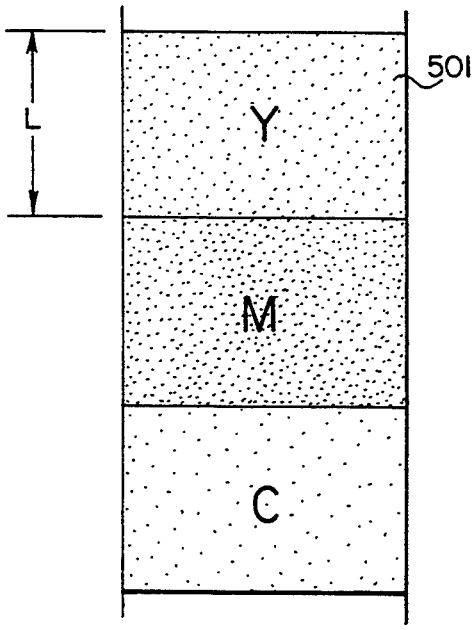
FIG. 6 (*a*) and (*b*) are diagrams illustrating an ink sheet and printing areas.
Figure 6B:
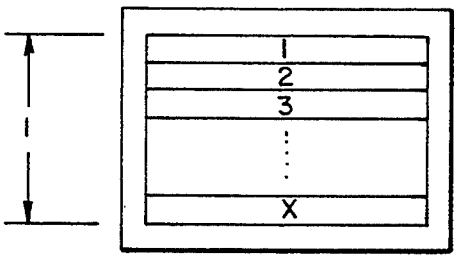

FIGS. 6 (*a*) and (*b*) are diagrams showing arrangement of color ink areas on an ink sheet 501 and showing a printing area which is used to record on a recording medium. In FIG. 6 (*a*), a letter "L" shows a length of one color area on an ink sheet. In FIG. 6 (*b*), a letter "I" shows a length of a printing area on a recording medium (a recording paper 504). As shown in FIG. 6 (*a*), three color areas, such as yellow (Y), magenta (M) and cyan (C), are arranged on the ink sheet 501. As shown in FIG. 6 (*b*), the printing area of image data is divided into X blocks, each having 15 lines. For example, for A4 size paper (295 mm×210, but the printing area is actually 286 mm×205 ram), the number of printing lines on the recording paper is 3378 and a number of blocks X is 225 (i.e. 3378/15). Consequently, the counting part 101 counts a number of maximum density pixels 225 times and determines each speed ratio n.

In the prior art, it is difficult to produce an accurate image using an ink sheet on which three color areas are repeatedly arranged in order because an undesirable color image can be printed on the recording paper when the determined speed ratios indicate that a length of an ink area to be fed in printing of the 225 blocks is longer than the length L of one color area on the ink sheet.

In the second embodiment of the invention, the length to be fed in for printing one color is limited so as not to exceed the length L. A process is added, which is described below, to the correcting process of the flowchart (the step 306 in FIG. 3) of the first embodiment to thereby obtain an accurate color image on the recording medium without producing an undesirable color image.

A description will be given of the correcting process performed according to the second embodiment.

In FIG. 4, $n_1$ to $n_x$ represent values for n which have been calculated for each block and the letter "a" represents the length of a block in the feeding direction. As shown in FIG. 4 (2), the length of ink sheet which will be printed is determined using the value of "a".

The greater the feeding speed of the ink sheet (i.e., the smaller speed ratio n), the greater the quantity of ink which is used in printing. Therefore, the length of an ink sheet to be used for a block i is $a/n_i$. Accordingly, as shown in the equation below, a letter "M" which represents the quantity of ink to be used in printing, can be calculated by summing all of the $a/n_i$ for the 225 blocks.

The equation (1) is shown as follows:

$$M = \sum_{i=1}^{x} \frac{a}{n_i} \tag{1}$$

The letter "M" represents the total length of an ink sheet to be used in printing.

If the calculated length M is longer than the actual length L, the difference (M−L) is distributed by a ratio of $a/n_i$, that is $((a/n_i)/M)$, as shown in equation 2. Each distributed difference is subtracted from each $a/n_i$. A normalized ink sheet length to be used for each block, Z, is calculated. Further, each new value of n is calculated by dividing each length "a" by the value of Z for each block.

The equation (2) is shown as follows:

$$Z = \frac{a}{n_i} - \left\{ (M - L) \times \frac{a/n_i}{M} \right\} \quad (2)$$

$$(i = 1 \text{ to } x)$$

"Z" represents a normalized length of ink sheet to be used for each block in printing after correcting.

$$\text{New } n \text{ value} = \frac{a}{Z} = \frac{a}{a/n_i - \left\{ (M - L) \times \frac{a/n_i}{M} \right\}}$$

Each speed ratio n, which is used when calculating an ink sheet length to be used to print a document, is recorded in the memory 102 every time a speed ratio n is determined, in the manner described above for the first embodiment, As discussed above, operation of the second embodiment is similar to operation of the first embodiment. Further, as the speed ratios n are determined by taking the actual ink sheet length into consideration, an accurate image can be provided even in a thermal transfer printer using an ink sheet which is arranged in order with a plurality of repeated color areas.

Figure 7:
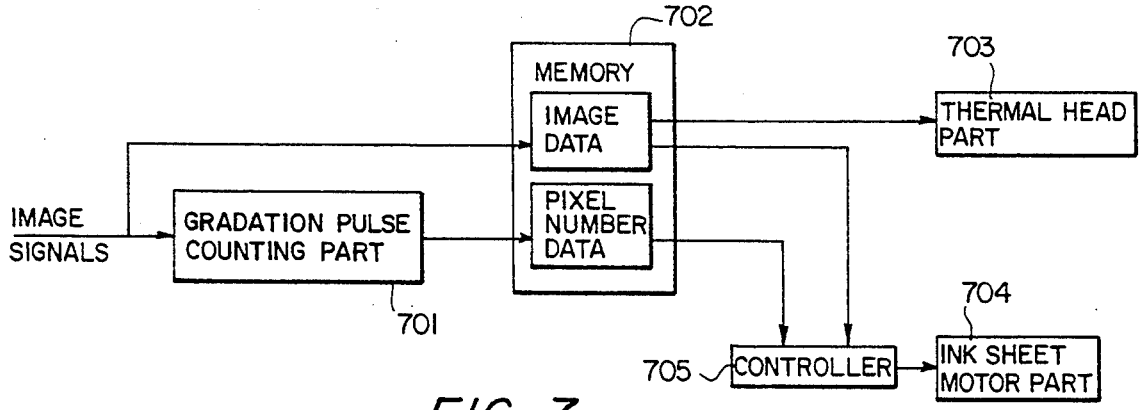
FIG. 7 is a schematic block diagram showing a thermal transfer printer of the third embodiment.

The third embodiment relates to a thermal printer having a plurality of thermal heads corresponding to a number of color ink sheets. FIG. 7 is a block diagram of the thermal printer according to the third embodiment.

The printer includes a gradation pulse counting part 701 which counts a number of gradation pulses (density information of document image data), for each divided block, (that is, each 15 lines of image date), a memory 702 in which image data and a number of gradation pulses are recorded, a thermal head part 703 which records images on a recording paper (a recording medium) using an ink sheet, an ink sheet motor part 704 for feeding an ink sheet and a controller 705 which controls all the parts and calculates speed ratios (n) Which are determined by dividing the feeding speed of the recording medium by the feeding speed of the ink sheet. Further, the controller 705 determines the speed ratios by referring a pulse number data table (a look-up-table) in which speed ratios corresponding to a number of gradation pulses are recorded. The revolutionary speed of the ink sheet motor 704 is determined and the motor 704 is driven according to the time between electrical pulses provided to the motor 704.

As discussed above, the gradation pulse counting part 701 counts how many pulses there are in a block of 15 lines of image data. For example, for A4 size paper (296 mm×210 mm, but the area which is actually to be recorded is 286 mm×205 mm), the number of printing lines on a recording paper is 3378 and the number of blocks on a recording paper is 225 (i.e. 3378/15). Consequently, the gradation pulse counting part 701 counts the number of gradation pulses for each 15 lines of the image data. In this example, the counting part 701 counts the gradation pulses 225 times. The following embodiments according to the present invention are explained for the case of 15 lines in a block and 225 blocks in a recording paper. However, the invention is not limited to these numbers being 225, 15 and 3378.

The structure of printing unit according to the third embodiment is omitted, as the structure is similar to the structure illustrated in connection with first embodiment as shown in FIG. 2.

Next, a description will be given of a speed ratio determining process performed according to the third embodiment.

The gradation pulse counting part 701 receives document image signals (document image data) and counts a number of gradation pulses for each block corresponding to divided image areas on the document. Since the gradation value of the document image signal is the same value as the gradation pulse, the number of gradation pulses can be calculated by adding the gradation values in order. The values counted by the gradation pulse counting part 701 are recorded in a portion of the memory 702. The controller 705 determines the speed ratios corresponding to the numbers of the gradation pulses and determines speeds for the yellow ink sheet 201*a*, the magenta ink sheet 201*b* and the cyan ink sheet 201*c* by multiplying interrupting time by values of n.

Figure 8:
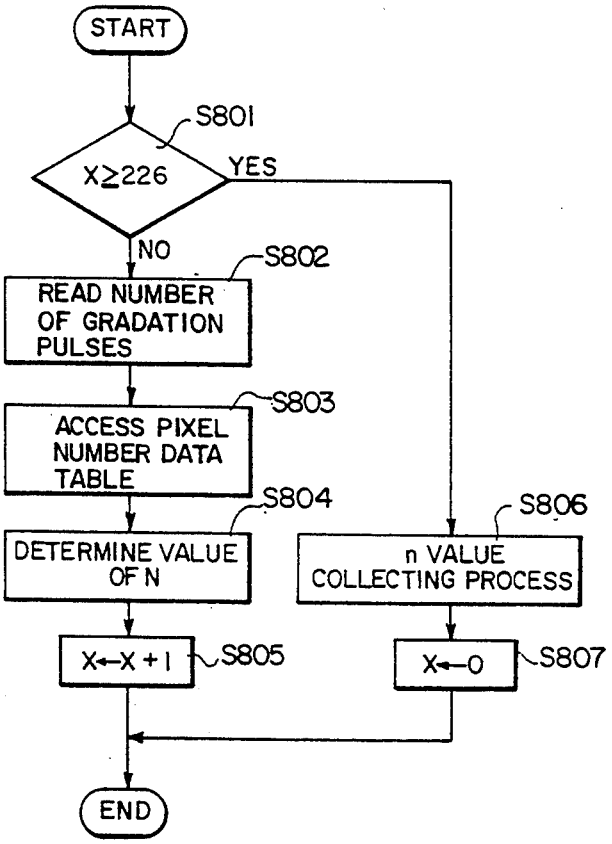
FIG. 8 is a flowchart showing calculating speed ratios in a third embodiment of the invention.
Figure 9:
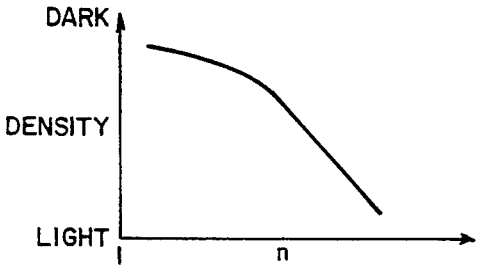
FIG. 9 is a graph showing a relation between speed ratios (n) and printing density.

Next, referring to FIG. 8, the calculating process will be explained.

At a first step 801, a determination is made as to whether values of all the blocks (225) have already been calculated. The process is advanced to a step 806 when x is larger than 225. On the other hand, the process is advanced to steps 805—805 when x is not larger than 225.

In the step 802, the number of gradation pulses which have been counted by the gradation pulse counting part 701 is read, and then a value of n is determined at the steps 803, 804 by referring to the pixel number data table in a program located in the controller 705. At that time, when the number of pixels is 0, that is, when there is no image data or the density level is 0 for all data within the divided block, n is set to a value appropriate for stopping the ink sheet motor 104 in order to not feed the ink sheet. Next, x which is the counter for the number of blocks in the present document image, is incremented at the step 805 and then the process ends.

In the step 806, a correcting process is executed for each speed ratio n after all the values of all the blocks have been calculated (x>225) in the step 801. Each speed ratio n of each block is recorded in the memory 702 after it is determined. Accordingly, all the speed ratios n have been recorded in the memory 702 when x reaches 225. The present document image block number x is set to 0 at a step 807 and the process ends.

Further, the correcting process for the values shown in the flowchart of FIG. 8 will be explained by referring to FIG. 4.

FIG. 4 is a diagram showing the correcting process. A document image is divided into X blocks. (In this embodiment, X is 225). In FIG. 4, the letter "a" indicates the length a block in the feeding direction of the ink sheet. The letter "I" indicates the length of the printing area in the feeding direction. As shown in (1), initially, a speed ratio difference between adjacent blocks is calculated. Without any further processing, the printing image would be recorded unevenly on the recording paper if there is a great difference in speed ratios between adjacent blocks. That is, the image would appear to have large density differences because the revolutionary speed of the ink sheet motor would have to change abruptly between the neighbor blocks when the speed ratio difference is more than 5.0. Therefore, in this embodiment, the revolutionary speed of the ink sheet motor 704 is limited to small changes and the effect of large density differences between neighbor blocks in document images is minimized.

As discussed above, as the speed ratios (n) are determined based on the gradation pulses (density information of document image data), appropriate speed ratios can be determined in order to use an ink sheet efficiently.

It is possible to efficiently use an ink sheet in response to fine density changes on a document image by dividing a document image into a plurality of blocks by counting gradation pulses and calculating a speed ratio for each block.

Further, it is possible to efficiently use an ink sheet, since the ink sheet is not fed in a block where there is no image data.

The fourth embodiment relates to a thermal transfer printer which records an image on a recording paper using a thermal head. As the structure of the fourth embodiment is basically the same as that of the third embodiment and the structure of printing unit is the same as that of the second embodiment as shown in FIG. 5, an explanation of basic structure of the forth embodiment is omitted.

Next, a description will be given of a process performed according to the fourth embodiment by referring to FIG. 5 and FIG. 6.

FIGS. 6(*a*) and (*b*) are diagrams explaining arrangement of color ink areas on an ink sheet 501 and printing area of a recording medium. In FIG. 6(*a*), a letter "L" shows the length of one color on an ink sheet. In FIG. 6(*b*), a letter "I" shows the length of a printing area on a recording medium (a recording paper 504). As Shown in FIG. 6(*a*), three color areas, yellow (Y), magenta (M) and cyan (C), are arranged on the Ink sheet 501. As shown in FIG. 6 (*b*), the printing area of image data is divided into X blocks, each containing 15 lines of image data. For example, for A4 size paper (286 mm×205 mm), the number of printing lines on a recording paper is 3378 and the number of blocks X is 225 (i.e. 3378/15). Consequently, the gradation pulse counting part 701 counts the number of gradation pulses 225 times and for each time a speed ratio is determined.

For a thermal printer using an ink sheet on which three color areas are arranged, an accurate image can be difficult to obtain because an undesirable color image can be printed on a recording paper when the determined speed ratios indicate that a length of an ink area to be fed in order to print the 225 blocks is longer than the length L of one color area on the ink sheet.

In the fourth embodiment, the length to be fed for each color is limited so as not to exceed the length L by adding a process, which is described below, to the correcting process for the values of n, shown in the flowchart (in the step 806 in FIG. 8) in the third embodiment. Thereby accurate color images can be provided on a recording medium without providing an undesirable image.

A description will be given of the correcting process for the values performed according to the fourth embodiment. In FIG. 4, $n_1$ to $n_x$ represent values of n, which have been determined for each block, and the letter "a" represents the length of a block in the feeding direction. As shown in FIG. 4 (2), the length of an ink sheet which will be used is calculated using the quantity "a".

The faster the feeding speed of the ink sheet (i.e., the smaller the speed ratio n), the greater the quantity of ink used. Therefore, the length of an ink sheet to be used is $a/n_i$. Accordingly, a letter "M", which represents the quantity of ink used to print one document, can be calculated by adding all the $a/n_i$ of 225 blocks as shown in an equation 3.

An equation 3 is shown as follows:

$$M = \sum_{i=1}^{x} \frac{a}{n_i} \tag{3}$$

The letter "M" represents a calculated value of the total amount of ink sheet length to be used to print one document.

The calculated length "M" is compared with the actual length "L". If the length "M" is longer, the difference (M−L) is distributed by the ratio of $a/n_i$, that is $((a/n_i)/M)$ of $a/n_i$ as shown in equation 4. The divided differences are subtracted from each $a/n_i$. Therefore, a quantity "Z" representing a normalized length of an ink sheet to be used for each corrected block, is calculated. Further, each new value of n is calculated by dividing each length "a" by each normalized ink sheet length "Z" of each block.

An equation 4 is shown as follows:

$$Z = a/n_i - \left\{ (M - L) \times \frac{a/n_i}{M} \right\} \quad (i = 1 \text{ to } x) \tag{4}$$

Z indicates a normalized length of ink sheet to be used each block after correcting.

$$\text{New } n \text{ value} = \frac{a}{Z} = \frac{a}{a/n_i - \left\{ (M - L) \times \frac{a/n_i}{M} \right\}}$$

Each of the speed ratios, which is used when an ink sheet length to be used to print a document is calculated, is recorded in the memory 702 every time one of the speed ratios is determined in a manner similar to that illustrated for the third embodiment.

As discussed above, the forth embodiment is similar to the third embodiment. Further, since the speed ratio is determined by taking an actual ink sheet length into account, an accurate image can be provided in a thermal transfer printer using an ink sheet having an arranged plurality of color areas.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. A thermal transfer printer for controlling a speed of an ink sheet based on density information of document image data, comprising:

counting means for counting a number of maximum density pixels in the document image data; and speed ratio changing means for changing a speed ratio between a feeding speed of a recording medium and a feeding speed of an ink sheet, the changing being based on the number of maximum density pixels which have been counted by said counting means;

wherein:

said counting means includes means for dividing the document image data into a plurality of blocks and counting a number of maximum density pixels for each of said blocks; and said speed ratio changing means changes the speed ratio during printing of each block based on the number of maximum density pixels.

2. A thermal transfer printer according to claim 1, wherein:

said speed ratio changing means changes the speed ratio during printing of blocks so as to reduce a difference between speed ratios between neighbor blocks when the difference exceeds a predetermined value.

3. A thermal transfer printer according to claims 1, wherein:

an ink sheet is arranged with a plurality of color ink areas, each color area having a color area length; and said speed ratio changing means changes the speed ratio so that a length to be fed for printing each color of a document does not exceed the color area length of a corresponding color area.

4. A thermal transfer printer according to claim 1, wherein:

said speed ratio changing means sets a feeding speed of an ink sheet in order to stop the ink sheet when there is no image data in a divided block of image data.

5. A thermal transfer printer for controlling a speed of an ink sheet based on density information of document image data, comprising:

counting means for counting a number of gradation pulses; and speed ratio changing means for changing a speed ratio between a feeding speed of a recording medium and a feeding speed of an ink sheet, the changing being based on the number of gradation pulses which have been counted by said counting means;

wherein:

said counting means includes means for dividing the document image data into a plurality of blocks and counting a number of gradation pulses for each of said blocks; and said speed ratio changing means changes the speed ratio during printing of each block based on the number of gradation pulses.

6. A thermal transfer printer according to claim 5, wherein:

said speed ratio changing means changes the speed ratio during printing of blocks so as to reduce a difference between speed ratios between neighbor blocks when the difference exceeds a predetermined value.

7. A thermal transfer printer according to claim 5, wherein:

an ink sheet is arranged with a plurality of color ink areas, each color area having a color area length; and said speed ratio changing means changes the speed ratio so that a length to be fed for printing each color of a document does not exceed the color area length of a corresponding color area.

8. A thermal transfer printer according to claim 5, wherein:

said speed ratio changing means sets a feeding speed of an ink sheet in order to stop the ink sheet when there is no image data in a divided block of image data.

9. A thermal transfer printer for controlling a speed of an ink sheet based on density information of document image data, comprising:

counting means for counting a number of maximum density pixels in the document image data; and speed ratio changing means for changing a speed ratio between a feeding speed of a recording medium and a feeding speed of an ink sheet, the changing being based on the number of maximum density pixels which have been counted by said counting means;

wherein:

an ink sheet is arranged with a plurality of color ink areas, each color area having a color area length; and said speed ratio changing means changes the speed ratio so that a length to be fed for printing each color of a document does not exceed the color area length of a corresponding color area.

10. A thermal transfer printer for controlling a speed of an ink sheet based on density information of document image data, comprising:

counting means for counting a number of gradation pulses; and speed ratio changing means for changing a speed ratio between a feeding speed of a recording medium and a feeding speed of an ink sheet, the changing being based on the number of gradation pulses which have been counted by said counting means;

wherein:

an ink sheet is arranged with a plurality of color ink areas, each color area having a color area length; and said speed ratio changing means changes the speed ratio so that a length to be fed for printing each color of a document does not exceed the color area length of a corresponding color area.

11. A thermal transfer printer for controlling a speed of an ink sheet based on density information of document image data, wherein the ink sheet includes a plurality of color ink areas having respective color area lengths, the thermal transfer printer comprising:

counting means for counting a number of gradation pulses;

correcting means, responsive to the counted number of gradation pulses from the counting means, for providing a corrected value when a length of the ink sheet to be fed while printing a color associated with a respective color area length is not substantially equal to the respective color area length; and speed ratio changing means for changing a speed ratio between a feeding speed of a recording medium and a feeding speed of an ink sheet, the changing being based on the corrected value provided by the correcting means so that the respective color area length of ink is used but ink from a subsequent color ink area is erroneously used.

12. The printer of claim 11, wherein:

said counting means includes means for dividing the document image data into a plurality of blocks and counting a number of gradation pulses for each of said blocks; and said speed ratio changing means changes the speed ratio during printing of each block based on the number of gradation pulses and based on the corrected value.

13. The thermal transfer printer of claim 12, wherein:

said speed ratio changing means changes the speed ratio during printing of blocks so as to reduce a difference between speed ratios between neighbor blocks when the difference exceeds a predetermined value.

14. The thermal transfer printer of claim 12, wherein:

said speed ratio changing means sets a feeding speed of an ink sheet in order to stop the ink sheet when there is no image data in a divided block of image data.

* * * * *